US005743822A

United States Patent [19]

Tarleton

[11] Patent Number: 5,743,822

[45] Date of Patent: Apr. 28, 1998

[54] DOUBLE STRINGED TENNIS RACQUET

[76] Inventor: Barry A. Tarleton, Box C374 1525 Aviation Blvd., Redondo Beach, Calif. 90278

[21] Appl. No.: 818,993

[22] Filed: Mar. 17, 1997

[51] Int. Cl.[6] ..... A63B 51/06

[52] U.S. Cl. ..... 473/533

[58] Field of Search ..... 473/524, 533

[56] References Cited

U.S. PATENT DOCUMENTS

| | | | |
|---|---|---|---|
| 3,904,202 | 9/1975 | De Lorean | 473/533 X |
| 3,968,966 | 7/1976 | D'Aquanni | 473/533 |
| 4,049,269 | 9/1977 | Blackburne | 473/533 |
| 4,204,680 | 5/1980 | Blackburne | 473/533 |
| 4,320,900 | 3/1982 | Blackburne | 473/533 |
| 5,423,532 | 6/1995 | Huang | 473/533 |
| 5,443,575 | 8/1995 | Huang | 473/533 X |

*Primary Examiner*—William E. Stoll

[57] ABSTRACT

A tennis racquet for employment during the game of tennis by enhancing a player's ability to produce spin and drop shots which includes a holeless oval frame head having front and back faces provided with spaced-apart grooves and having a continuous side groove about the outside side of the frame. The outside peripheral edge further includes connecting grooves or slots that join the terminating ends of the front and back face grooves. The face grooves, the side connected grooves or slots and the edge groove define a series of projections about which a racquet string is trained so as to crisscross over the central opening of the oval frame. The grooves and slots are of sufficient depth to support the string so as to appear above the surfaces of the frame. The projections defining the continuous edge groove include an arcuate channel mateable with the curvature of the string as the string bears against the projection. Therefore, a double stringed tennis racquet is provided so that the tennis ball will engage with only the string element and not the frame itself.

5 Claims, 2 Drawing Sheets

10
11
11'
12
12'
18
20
21
22
24
25
26
26'
27
30
31
32
33

DOUBLE STRINGED TENNIS RACQUET

BACKGROUND OF THE INVENTION

1. Field of the Invention

The present invention relates to the game of tennis, and more particularly to a novel tennis racquet provided with a double string bed having the string of the racquet substantially coplanar with the respective front and back faces of the frame head.

2. Brief Description of the Prior Art

Conventional tennis racquets are provided with a single string bed of overlapped longitudinal and transverse strings stretched between and across the opening of the racquet frame head. With this conventional stringing arrangement, tennis balls striking the frame of the racquet cannot be returned with the accuracy normally obtainable where the tennis ball strikes the main portion of the string bed. In such instances, the tennis ball travels in an uncontrolled manner and at wide angles not intended by the player.

Some attempts have been made to avoid this problem by stringing the racquet head with a double string bed so that the frame head of the racquet is less exposed to impacting with the tennis ball. However, such prior attempts to provide a double string bed involved the drilling of holes through the frame itself or by employing a plurality of tubes into which the string was inserted as it passed through the frame. In other instances, additional clips, clamps and screws for retention have been used. However, the strings are not above the front and back surfaces of the racquet head so that accuracy is still seriously compromised. Such prior double string bed racquets are disclosed in U.S. Pat. Nos. 5,443,575; 5,467,982; 5,192,072; 4,141,549 and 4,320,900. Still a further disclosure is included in U.S. Pat. No. 3,968,966. All of the disclosures in these patents suffer from employment of tubes, holes in the frame or special retaining devices and in most instances, the strings crossing the front and back faces of the frame are fully unexposed and non-coplanar with the surface of the faces.

Therefore, a long-standing need has existed to provide a tennis racquet provided with a double string bed wherein one bed is looped over the front face of the tennis racquet frame while the other string bed is looped over the rear or back face of the frame. It is best to have the ability to string the string bed onto the frame head of the racquet without the use of tubes or holes so that the structural integrity of the frame head is not adversely affected. With such an arrangement, it is believed that maximum control of the tennis ball can be achieved even when the ball strikes the portion of the racquet adjacent the frame or the frame itself.

SUMMARY OF THE INVENTION

Accordingly, the above problems and difficulties are avoided by the present invention which provides a tennis racquet which includes a holeless oval frame head having a front and a back face provided with spaced-apart grooves or recessed cuts which are used to receive a string therein as the string is trained to overlap in a longitudinal and transverse direction across both front and rear or back faces of the frame head. Specifically, spaced-apart transverse grooves are placed across the front and back surfaces of the front and back faces and a continuous side edge groove is provided about the outside of the frame head. The outside peripheral edge further includes connecting grooves or slots that join in the terminating ends of the front and back face grooves. The face grooves, the side connecting grooves or slots and the edge groove define a series of projections about which the racquet string is trained so as to crisscross over the central opening of the oval frame. The grooves and slots are of sufficient depth to allow the string to appear above the face surfaces of the frame. The projections defining the continuous edge groove include an arcuate channel mateable with the curvature of the string as the string bears against the projection. Therefore, a double stringed bed is provided with the string trained about the frame head in a recessed position so that the string is substantially coplanar with and above the front and back faces of the frame head.

Therefore, it is among the primary objects of the present invention to provide a double string bed for a tennis frame head which will provide maximum control of a tennis ball even when the ball strikes the portion of the racket head frame adjacent to or on the frame itself.

Another object resides in providing a double stringed frame with the string being raised above the front and rear faces or surfaces of the frame head so that mishits of the ball adjacent the frame or even off of the frame will have a greater chance of being viable shots.

Still a further object of the present invention is to provide a novel racquet having a frame member forming a head portion with duplicate string ball-striking matrices and wherein each matrix is substantially raised above the respective front and rear face surface of the frame member.

Still a further object is to provide a stringed racquet of the double bed type without the need or use of holes in the frame or without the need or use of tubes which require installation on the frame.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
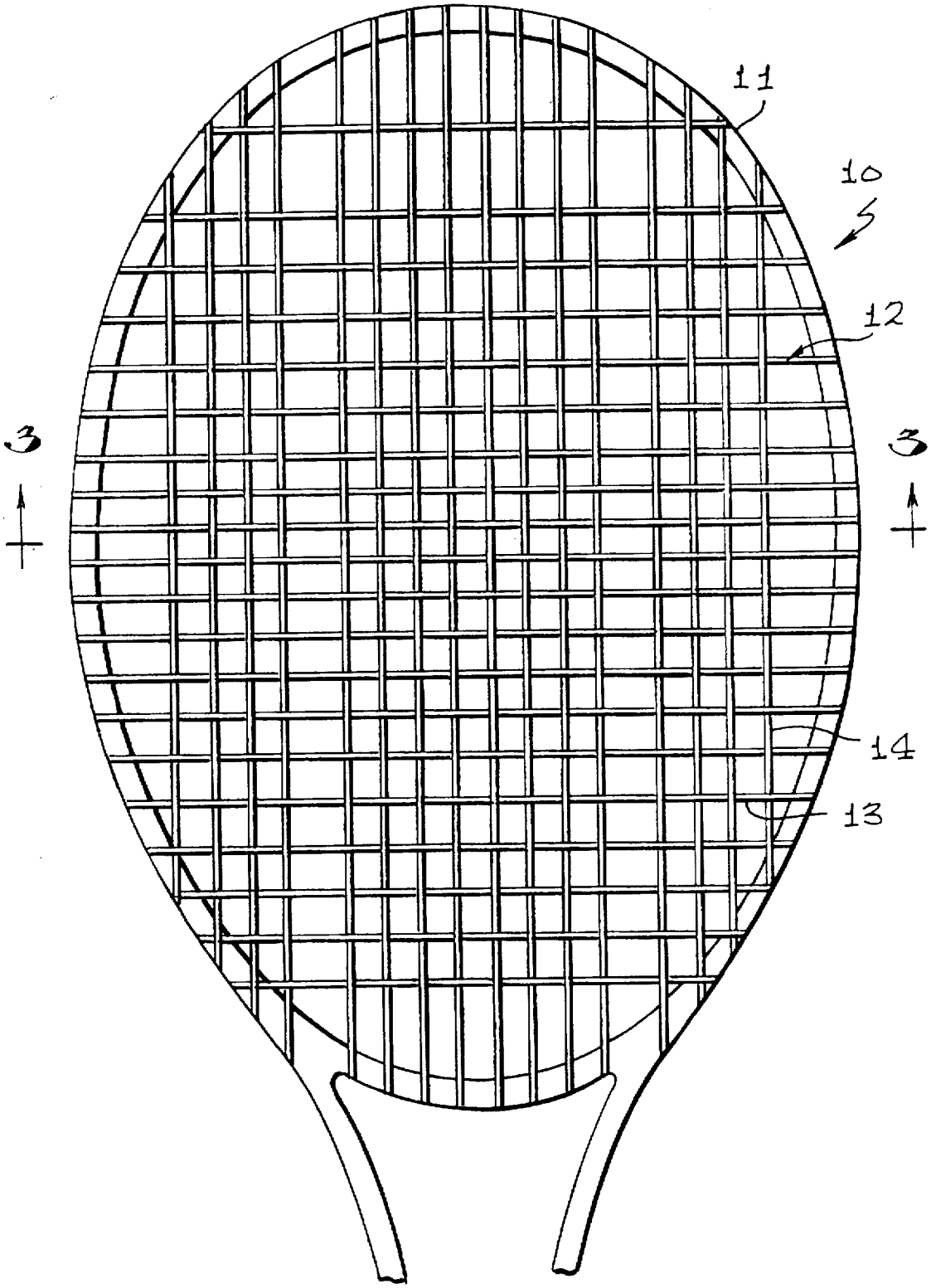
FIG. 1 is a front elevational view of a racquet head employing a double string bed in accordance with the present invention.

Referring to FIG. 1, the inventive tennis racquet incorporating the present invention is indicated in the general direction of arrow 10 which includes a frame head 11 generally shaped as an oval with a central opening across which a plurality of string element runs are trained. The string element is indicated by numeral 12 and it can be seen that the total string bed comprises cross-over of the string runs in both a transverse direction, as represented by numeral 13, as well as in a longitudinal orientation, as indicated by numeral 14. The string element is a continuous filament which is initially carried on the frame head by means of forming a knotted loop 15 and which is then strung about the peripheral edge of the frame head to terminate at its opposite end in a knotted loop 16. Where the loops terminate is not a part of the present invention and in some instances, the loop may terminate at the top of the frame head which is indicated by numeral 17. It is to be particularly noted that the string bed is double sided so that the transverse and longitudinal arrangement of string element runs is duplicated on the other side of the frame head from that illustrated in FIG. 1. Therefore, the double stringed framed head incorporates a first side associated with one side of the frame head while the other string bed forms a string relationship on the opposite side. The runs of transverse and longitudinal runs are parallel to one another in the front elevational view between the two beds of string elements. Therefore, it can be seen that a double string frame head is provided and that the strings are trained over the edge of the frame head 11 and wound about the opposite side to form the other string bed. A handle or hand-grasping portion of the racquet is indicated by numeral 18 and downwardly depends from the head 11; however, the handle does not form a part of the present invention.

Figures 2, 3, 4:
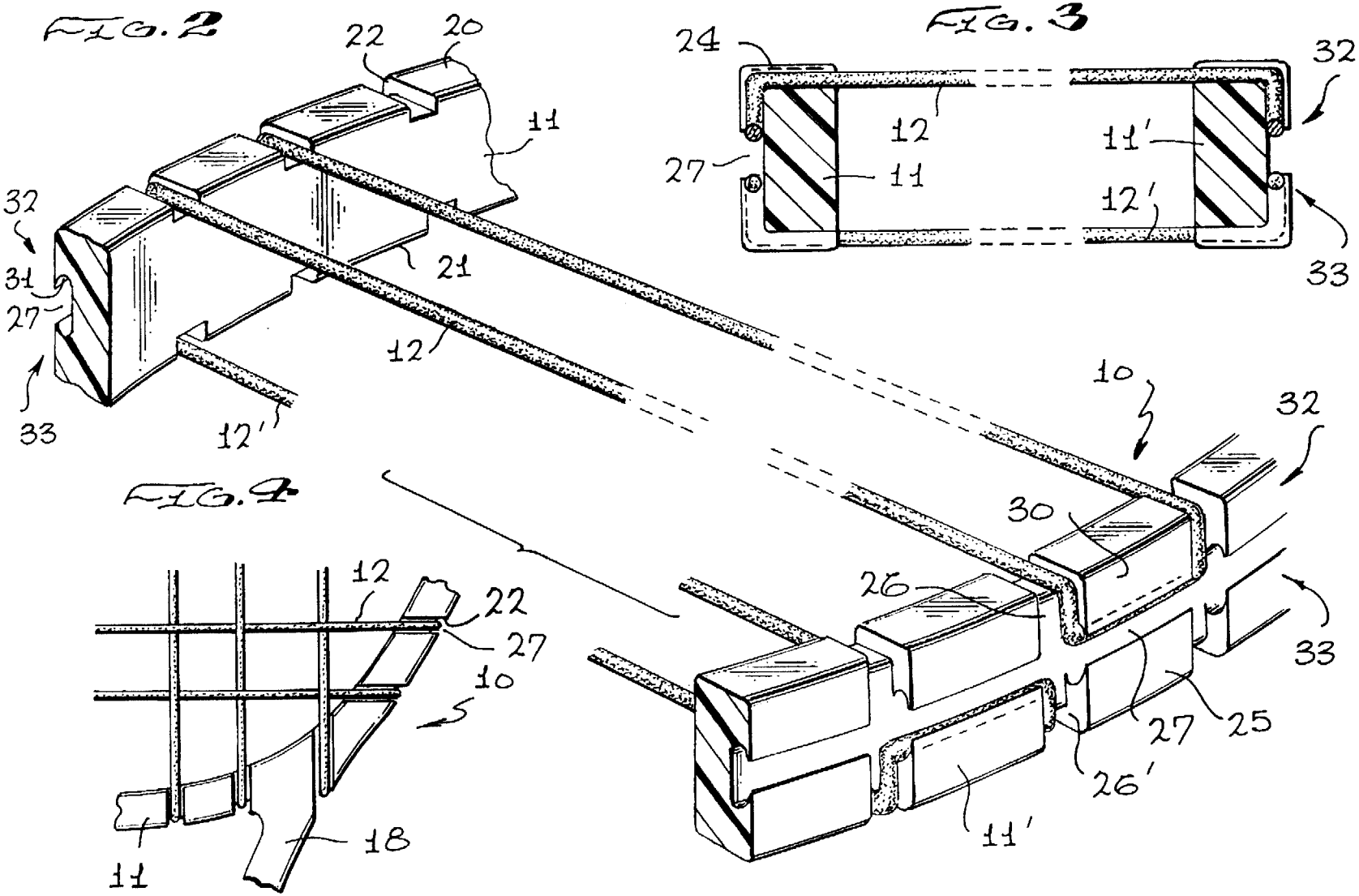
FIG. 2 is a greatly enlarged perspective view illustrating the stringing of a string element about the frame as used in the double bed string arrangement shown in FIG. 1.
FIG. 3 is a transverse cross-sectional view of the frame head illustrating the raised relationship of the string as it is looped over the frame, as shown in FIG. 2.
FIG. 4 is a fragmentary view of the crisscross arrangement of the string as it is trained through grooves on the frame.

Referring now to FIG. 2, an enlarged perspective view of the inventive frame head is illustrated in which numeral 11 represents one side of the frame while numeral 11' illustrates the other side of the frame between which runs of the string element 12 are trained. The runs of the string element provide a string bed on one side of the frame head, such as the string element indicated by numeral 12, while an additional run of the string element across the opposite side of the frame head is indicated by numeral 12'. It can be seen that both the front face 20 and the rear face or back face 21 are provided with a plurality of recessed cuts or grooves, such as groove 22. The grooves 22 are not only spaced-apart according to a regular dimension but are considered to be transverse or lateral grooves which are open-ended and extend across the faces 20 and 21. Therefore, the string element 12 can be laid into the recessed cut or groove so that the string substantially occupies the groove and whereby a small portion of the string element diameter is permitted to protrude above the surface 20 or 21. The protruding portion is indicated by numeral 24 in FIG. 3. The exterior edge surface, such as indicated by numeral 25, is provided with a plurality of spaced-apart connecting grooves, such as connecting groove 26. A connecting groove accommodates training of the string element not only through the groove 21 but permits training the string element downwardly through the connecting groove 26 to communicate with a continuous edge groove 27 extending about the complete external edge surface 25 of the frame head 11.

With reference to FIGS. 2 and 3, it can be seen that the grooves 22 terminate with the connecting grooves 26 that in turn communicate with the continuous groove 27 so that a portion of the frame head between adjacent grooves 26 define a projection, such as indicated by numeral 30 about which a portion of the string element is looped or trained. The portion or projection 30 includes an undersurface 31 which is curved or arcuate in configuration so that the shape of the groove will match the round shape of the string element 12. It can be seen that the projections serve as lugs and that the undersurfaces 31 of each of the respective projections or lugs 30 define the opposite sides of the continuous edge groove 27. In other words, the exterior edge of the frame head 11 and 11' includes an external edge surface 25 which is divided between a first row of lugs, such as identified by row 32, and a second row of lugs, identified by numeral 33. Therefore, it can be seen that as the string element 12 is trained through the respective grooves 22, the string element then progresses through the groove 26 and is then looped around the adjacent lug through groove 31 associated with continuous groove 27 and then the string element is turned upward through the next groove 26 and reversed to be trained through the associated groove 22 for a run across the opening of the frame head to the opposite frame 11.

As illustrated in FIG. 4, the opposite ends of the runs are looped underneath the lugs or projections 30 and are trained and interwoven in a crisscross arrangement across the opening of the oval frame head.

Therefore, it can be seen that the inventive tennis racquet frame head of the present invention provides a double matrices of crisscrossing string element beds so that the string element forms a continuous surface of ball striking area wherein the ball may be induced to provide spin and drop shots and particularly prevent frame hits. The use of the inventive frame head creates different types of spin serves as well as better touch on drop shots. Also, other tennis shots, such as top spin or under spin forces placed on the ball are greatly enhanced. Construction of the inventive tennis racquet is not labor intensive since a multiplicity of holes or installation of tubes is not necessary. Even in the event of hole usage, it is labor intensive to continually insert the string element through each of the respective holes in order to mount the string in proper location.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A double stringed racquet comprising:

a racquet frame having an oval frame head with a central opening defined by an encircling frame;

said frame having a plurality of spaced-apart lateral grooves across the opposite face surfaces of said frame and a continuous edge groove with a plurality of connecting slots communicating said lateral grooves with said continuous edge groove;

a plurality of lugs defined between adjacent spaced-apart connecting slots and terminating with said continuous edge groove;

a string element trained across said frame head opening in a crisscross pattern on both sides of said frame head to provide a double stringed frame head;

said string element further being trained about said plurality of lugs and terminating in securement loops at its opposite ends with said frame.

2. The racquet defined in claim 1 wherein:

a portion of said string element occupying each of said lateral grooves protrudes beyond the surface of said frame.

3. The racquet as defined in claim 2 wherein:

each of said lugs is provided with an arcuate undercut channel between adjacent connecting slots in communication with said continuous edge groove for engagement with said string element in conformal relationship.

4. A double stringed racquet comprising:

a frame head having opposite sides defining a central opening;

a string element trained on said frame head to provide a double bed of said string element;

said frame head having a plurality of lugs providing a first row and a second row separated by a continuous edge groove;

said string element trained about each of said lugs to provide a pair of string beds separated by said central opening; and portions of said string element appearing and exposed beyond said frame head so as to prevent engagement of a ball with said frame head.

5. The racquet as defined in claim 4 wherein:

said frame head is provided with lateral grooves and connecting slots communicating with said edge groove for conducting said string element about said respective lugs.

* * * * *